United States Patent [19]

Bein

[11] Patent Number: 4,981,424

[45] Date of Patent: Jan. 1, 1991

[54] HIGH PRESSURE SINGLE SCREW COMPRESSORS

[75] Inventor: Thomas W. Bein, Annapolis, Md.

[73] Assignee: The United States of America as represented by the Secretary of the Navy, Washington, D.C.

[21] Appl. No.: 287,352

[22] Filed: Dec. 21, 1988

[51] Int. Cl.[5] ..... F01C 3/06; F01C 19/00

[52] U.S. Cl. ..... 418/99; 418/141; 418/195

[58] Field of Search ..... 418/97, 99, 141, 195

[56] References Cited

U.S. PATENT DOCUMENTS

| | | | |
|---|---|---|---|
| Re. 30,400 | 9/1980 | Zimmern | 418/188 |
| 3,133,695 | 5/1964 | Zimmern | 418/195 |
| 3,632,239 | 1/1972 | Zimmern | 418/150 |
| 3,932,077 | 1/1976 | Zimmern | 418/195 |
| 3,945,778 | 3/1976 | Zimmern | 418/195 |
| 3,965,697 | 6/1976 | Beierwaltes | 62/402 |
| 4,321,022 | 3/1982 | Zimmern | 418/195 |
| 4,373,881 | 2/1983 | Matsushita | 418/195 |
| 4,824,348 | 4/1989 | Winyard | 418/195 |

FOREIGN PATENT DOCUMENTS

| | | | |
|---|---|---|---|
| 62-129587 | 6/1987 | Japan | 418/195 |

*Primary Examiner*—John J. Vrablik

*Attorney, Agent, or Firm*—Luther A. Marsh; John H. Stowe; Thomas S. O'Dwyer

[57] ABSTRACT

A single screw mechanism of the positive displacement rotary type such as a compressor or expander for varying the pressure of a fluid. A stationary housing having a bore symmetry surrounds and is configured to cooperate in a substantially fluid-tight manner with the surface of revolution of the crests of a compound conical mainrotor having a plurality of projecting spiral threads whose root width-thread height define substantially constant cross sectional chamber areas in the grooves between adjacent threads along their length for substantially fluid-tight engagement with the teeth of at least one rotatably mounted cylindrical gaterotor whose axis is symmetrically inclined at a transverse angle that is less than 90 degrees with respect to the fixed spin axis of said mainrotor so as to permit the toothed outer peripheral surface containing labyrinthial seals to extend through a window path opening in said housing thereby exposing one side of each gaterotor tooth face in meshing relation with the mainrotor chamber in the housing to the changed-pressure fluid during rotation. The housing is fitted with ports for the admission and discharge of fluid at opposite ends of said mainrotor, the ports for the passage of the changed-pressure fluid being axially aligned with the mainrotor and located in a discharge ring in close proximity whereat each gaterotor exits from engagement with the mainrotor. A hydrostatic type pressure port is provided in the housing on the suction side of the aforesaid window path.

29 Claims, 5 Drawing Sheets

FIG. 6
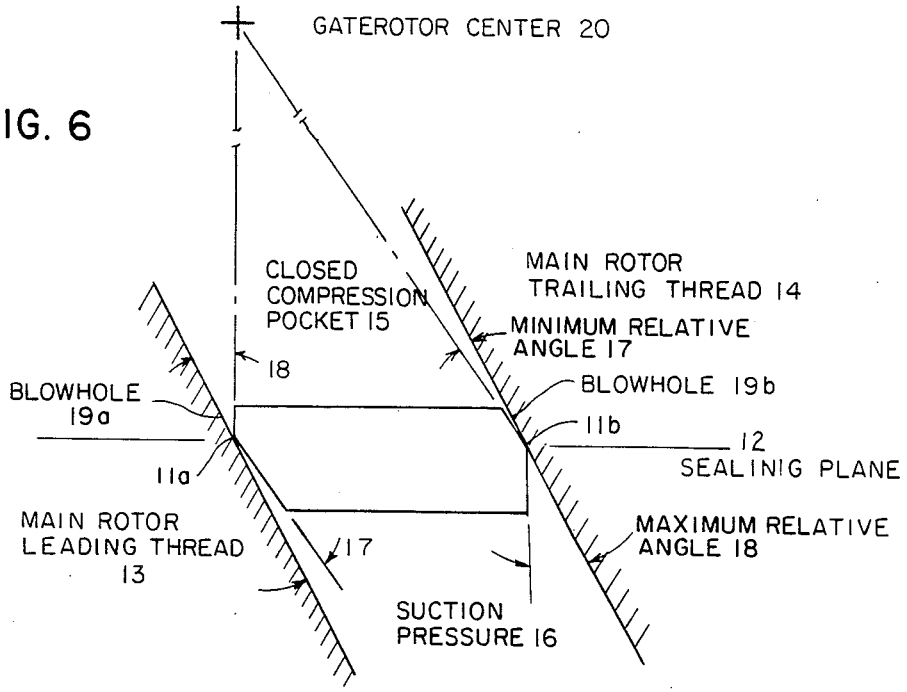
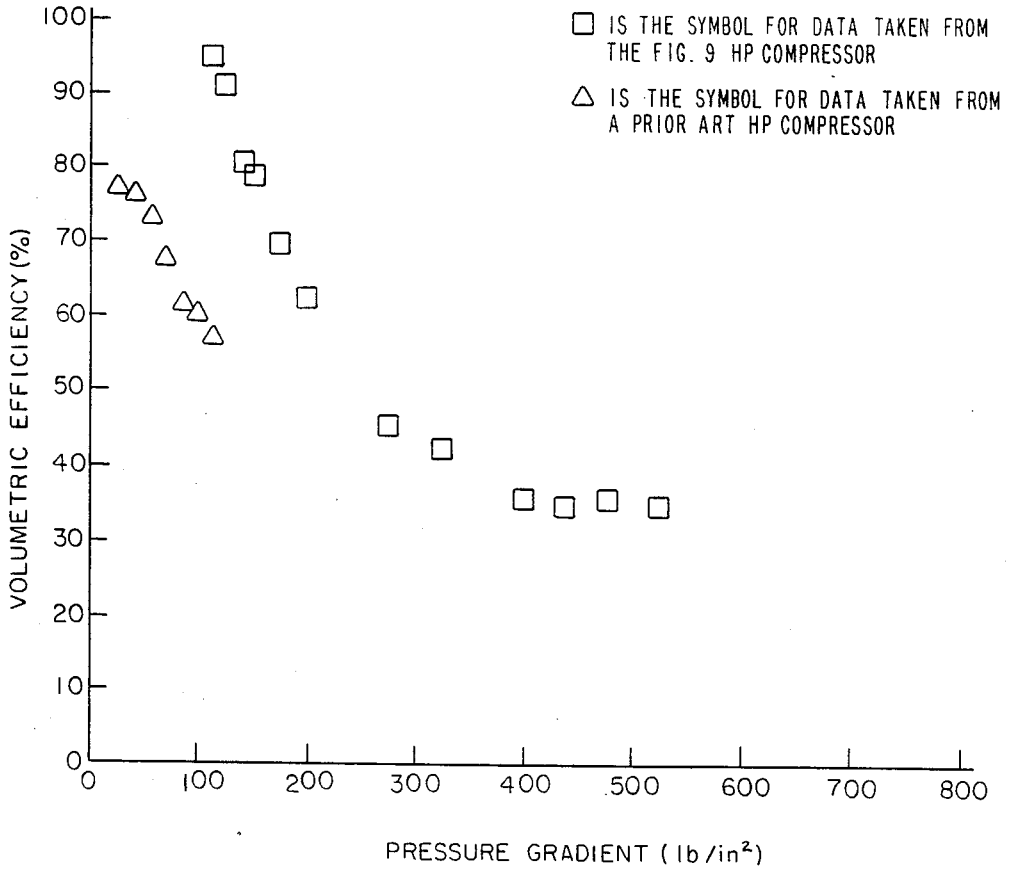
FIG. 10

HIGH PRESSURE SINGLE SCREW COMPRESSORS

The invention described herein may be manufactured and used by or for the Government of the United States of America for governmental purposes without the payment of any royalties thereon or therefor.

BACKGROUND OF THE INVENTION

1. Field of the Invention

The present invention relates to single screw mechanisms such as compressors and expanders specifically and hydraulic motors and pumps generally which are intended to operate on a compressible fluid at high pressure gradients.

2. Description of the Prior Art

The group of single screw compressors which is of concern to the present invention are classified as positive-displacement rotary type machines. This invention relates to single screw mechanisms that utilize a cylindrical mainrotor typically with cylindrical gaterotors. In a machine of this type, there is one mainrotor with a plurality of spiral threads that is driven by prime mover means so as to spin about a fixed axis within a fluid-tight stationary housing. There are usually two gaterotors, which are symmetrically disposed substantially transverse to the axis of the mainrotor, whose teeth are in meshing engagement with the threads of the mainrotor. The housing is provided with inlet and outlet ports for connecting the exterior of this mechanism respectively to a suction and to a discharge plenum. For a conventional machine of the prior art that is intended to raise the pressure of a gas, the process is as follows:

Gas is drawn through the inlet port into the thread of the mainrotor that is open to the suction plenum. After the thread has been filled, a gaterotor tooth rotates into a position where it closes off the filled thread and creates a pocket formed between the mainrotor thread, the gaterotor tooth, and the compressor housing. The mainrotor continues to turn and to decrease the volume of the pocket thereby compressing the entrapped gas. Where cylindrical type gaterotors are employed, depending upon the orientation of such to the mainrotor, either the outside or the inside of the gaterotor tooth can be arranged to sweep out the mainrotor thread. When the desired discharge pressure is reached, the edge of the mainrotor thread uncovers a radial discharge port and the gas is forced into the discharge plenum through this outlet port.

Mechanisms of this type are already well known and have been disclosed, by way of example, in U.S. Pat. Nos. 3,632,239, 4,373,881, and Re. 30,400 among many others. In the first of these, the inventor establishes an algebraic expression for the design of globoid-worm fluid compression-expansion machines which describes mainrotor thread-gaterotor teeth interface relationships and which is satisfied by the several embodiments depicted therein including a conical mainrotor and planar gaterotor geometry. In U.S. Pat. No. Re. 30,400, this same inventor describes a toroidal shaped mainrotor with a transverse mounted gaterotor whose teeth are inclined outward from the axis of said gaterotor and which penetrates the compressor housing through a milled window opening path for engagement. In U.S. Pat. No. 4,373,881, a conical mainrotor having a plurality of helical screw threads is engaged with a cylindrical gaterotor for increased fluid discharge volume by way of increasing the contact length and depth of each gaterotor tooth with each mainrotor groove.

The single screw machines which are available as stock items generally operate at pressures ranging from 60 to 150 psi. This is suitable for most plant systems which are maintained at 90 to 140 psi pressure in order to operate tools and machines which require 70 to 125 psi. However, when higher pressure applications are required, these machines must be multi-staged. This is because the prior art machines' design allow a large number of leakage paths where the trapped fluid can escape from the closed compression chamber. Due to the relative motion between the parts of the machine, the clearance between these parts can only be reduced to minimum finite tolerances. Yet, even when the minimum clearances have been achieved, the volumetric efficiency in the conventional machines has been demonstrated to be closely related to the absolute pressure gradient between the discharge and suction plenums. Therefore, many attempts at reducing the leakage paths have been made and have resulted in various improvements.

In U.S. Pat. No. 3,965,697, labyrinthial seals are incorporated in a lobe type air compressor on the inner wall of the casing bores and on the tips of all of the male lobes to prevent leakage. U.S. Pat. No. 3,945,778 discloses a compression-expansion machine with a cylindrical mainrotor and planar gaterotor geometry which is characterized by gaterotor teeth in which each tooth has two offset rectilinear flanks for obtaining increased compression ratios by reducing leakage past the flank. In U.S. Pat. No. 3,932,077, volumetric discharge is increased by a gaterotor tooth seal which has arc shaped flanks so that surface to surface contact with the mainrotor thread is made within a zone. The major drawbacks of this latter design are that mainrotor thread machining takes a long time and that whenever parallel cylinder profiles are used, leakage past the flank areas becomes major. Recognizing these difficulties, U.S. Pat. No. 4,321,022 proposes gaterotor teeth flanks comprising at least three skewed surfaces which intersect in at least two edges so as to provide dual lines of sealing with the mainrotor thread.

The previously discussed single screw mechanisms are representative of pertinent designs and improvements thereto as disclosed by others when attempting to increase the volumetric efficiency of these machines. Although several embodiments have been discussed, the designs of the prior art contain various limitations and offsetting disadvantages when applied to the high pressure realm so that the effort to reduce leakage remains a major consideration in single screw machinery design. The embodiments hereinafter illustrated and described are distinguishable in the many ways they create better performing machines for operating on a compressible fluid with a high pressure gradient.

SUMMARY OF THE INVENTION

To overcome the problems of the prior art, the applicant has provided a new, improved construction for a high pressure single screw mechanism in which leakage from the closed compression chamber to the suction plenum through the interface between the mainrotor thread, gaterotor teeth, and compressor housing is reduced. The rate at which the volume is swept out of the mainrotor is controlled to produce a pressure curve which corresponds to a positive rate of volume change. This reduces the amount of time that the leakage paths are exposed to the high pressure. The mainrotor is configured so that the volume in the thread is swept out slowly at the beginning of the cycle and more quickly at the end. Delaying the compression of the gas until the later end of the cycle reduces the losses out of the compression pocket by reducing the time that significant pressure differentials across the thread leakage paths exist. A new construction accomplishes these objectives by a design in which the compound conical mainrotor has a truncated conically tapered base surface with a plurality of projecting spiral threads whose crests are parallel to such conical base surface and wherein the root width-thread height of this mainrotor define substantially constant cross sectional chamber areas between adjacent threads along their length.

Leakage past the gaterotor tooth flanks have also been reduced in the present invention by selection of the angle of inclination and the centerline distance between the mainrotor axis and the gaterotor axis, the gear ratio of the gaterotor relative to the mainrotor, the size of the rotors and the angles of engagement between the gaterotor and the mainrotor. The interrelationship between these parameters is optimized to achieve the minimum change in relative angle between the gaterotor and the mainrotor during the period of engagement. The objective for minimizing the relative angle change seen by the gaterotor tooth flanks is to increase the resistance to leakage flow past the flank paths.

Another improvement necessitated by the application of single screw mechanisms to high pressure gradients that has also been incorporated into the present invention includes an axial discharge port. This discharge port, which is aligned in parallel with respect to the spin axis of the mainrotor in the discharge ring, permits adjustment of the seal clearance between the mainrotor threads and the contact plate of the discharge ring which forms the lower portion of the two part compressor housing.

Labyrinthial seals have also been fitted on both the interior and exterior surfaces of the cylindrical gaterotor. On the inside of the gaterotor, serrated seals are formed by cutting staggered circumferential grooves above the teeth root line on an extended cylinder wall. On the exterior surface of the gaterotor, an array of dimpled indentations have been provided above the teeth root line and function in a similar manner to reduce leakage at the window path opening .rom the end of the gaterotor by creating additional turbulence.

In the preferred embodiment, a hydrostatic type pressure port has also been introduced on the suction side of the gaterotor window opening path. The size and geometry of the port orifice is proportioned to counteract the bending moment force exerted on the tooth by the compression process. When this port is fed by fluid whose pressure is substantially opposite to the compression force which is developed on the other side of the gaterotor tooth face, it will act to counter balance the compression force and permit the use of self supporting gaterotor teeth.

Accordingly, it is an object of this invention to provide a single screw mechanism wherein leakage is reduced and which demonstrates improved operation on a compressible fluid at high pressure gradients.

It is also an object of this invention to provide a positive rate of volume change so as to delay the compression process and thus reduce leakage out of the closed compression chamber.

It is a further object of this invention to decrease the gaterotor teeth length so as to reduce deflection and the resulting losses past the gaterotor teeth.

Another object of this invention is to provide a low relative angle change on the gaterotor tooth flank so as to increase the resistance to flow and reduce the leakage past the tooth flank.

Yet another object of this invention is to introduce a hydrostatic type pressure port on the non-compression side of the gaterotor which functions to keep the clearance of the gaterotor teeth as they pass the window opening path at a close tolerance and allows for a reduction in gaterotor tooth thickness.

It is also an object of this invention to arrange the geometry so that the root gap between two adjacent gaterotor teeth and the mainrotor remains constant, which in combination with the hydrostatic type pressure port, reduces blowhole leakage at the mainrotor thread crest-gaterotor tooth root-compressor housing interface.

It is a further object of this invention to provide an axial discharge port which makes it possible to adjust the seal clearance between this port and the end of the mainrotor threads.

It is still a further object of this invention to employ labyrinth seals at the window path opening on both sides of the gaterotor cylinder wall so as to increase the resistance to flow and thereby reduce the pressure losses in the window leakage paths.

BRIEF DESCRIPTION OF THE DRAWINGS

FIG. 6 is an enlarged sectional view of the mainrotor thread-gaterotor tooth engagement taken along lines 6—6 of FIG. 4 showing minimum relative flank relief angles.

FIG. 10 is a plot of volumetric efficiency versus pressure gradients for a single screw high pressure mechanism of the prior art as compared with a high pressure compressor built in accordance with the teachings of this invention.

In the figures, like reference numerals designate like or corresponding components throughout the several views.

DETAILED DESCRIPTION OF THE INVENTION

When single screw mechanisms are used in applications that have a high pressure gradient, each of the volumetric loss passages must be designed to meet such high pressure conditions. These leakage paths and other factors that affect machine performance are of great importance and will be discussed individually as they pertain to the invention described herein.

Losses across the mainrotor thread from the closed compression pocket to the suction plenum can be reduced by diminishing the pressure differential across the boundaries of the compression pocket. This important objective is accomplished in the present invention by controlling the rate of volume change in the compression pocket. For theoretical purposes, assuming adiabatic compression of air and neglecting losses out of the pocket, the pressure in the pocket is described by the following equation: $P_p = P_i(V_i / V_p)^{1.4}$ where $P_p$ designates the absolute pressure in the compression pocket, $P_i$ designates the absolute inlet pressure, $V_i$ designates the thread volume when the gaterotor closes, and $V_p$ designates the instantaneous volume of the closed pocket opening.

Figure 1:
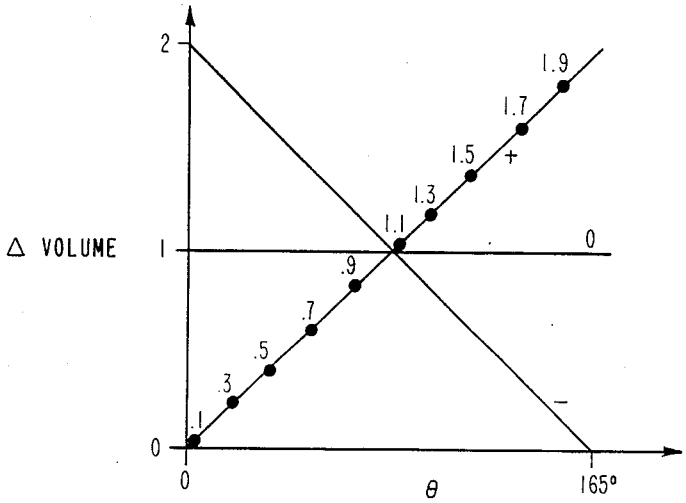
FIG. 1 is a plot of the characteristic rate-of-volume change versus mainrotor position for three types of single screw compressors.
Figure 2:
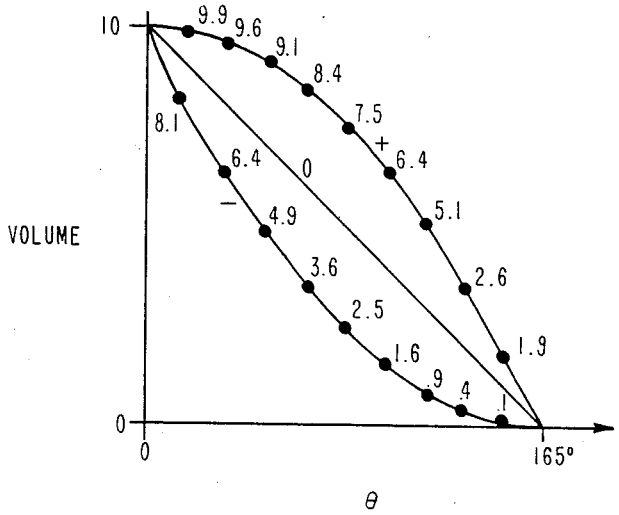
FIG. 2 is a plot of the volume histories for the three rate-of-volume change cases of FIG. 1.
Figure 3:
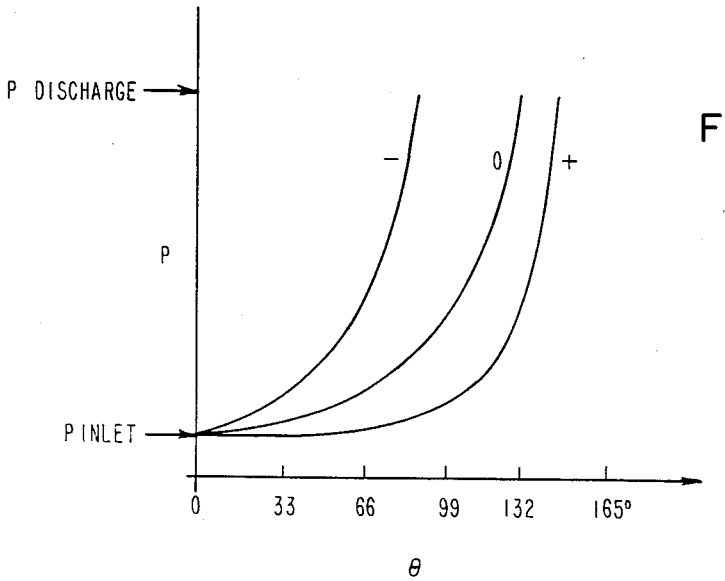
FIG. 3 is a plot of the pressure histories for the three rate-of-volume change cases of FIG. 1.

The rate at which the volume is swept out of the pocket has a major influence on the pressure in the pocket. FIG. 1 is a plot of the characteristic rate-of-volume change versus mainrotor position in degrees for three types of single screw machines. In FIGS. 1–3, one compression cycle is assumed to be completed for every 165 degrees of mainrotor rotation which is a typical value for machines of this type. The first line, identified with a (0) in FIG. 1, is a constant rate-of-volume change that results in slope of zero. The second line, identified with a (−), corresponds to a rate of change that decreases during the cycle which results in a negative slope and which represents the state of the art single screw compressors. The third line, identified with a (+), corresponds to a rate of change that increases during the cycle which results in a positive slope and which represents a single screw compressor design in accordance with the present invention. The notation indicating the slope of these curves is continued throughout FIGS. 2 and 3. For discussion, the total swept volume in FIG. 2 will be considered equal to 10. In FIG. 2, the volume of the pocket is plotted versus mainrotor position for the three rate-of-volume change cases from FIG. 1 data by subtracting the sum of preceding instantaneous volumes from the total volume at each interval of mainrotor rotation so as to develop each volume history. Recalling from the above mentioned equation that the pressure in the pocket can be computed if the ratio of inlet volume over instantaneous pocket volume is known, the volume histories in FIG. 2 were utilized to generate the corresponding pressure histories which are plotted in FIG. 3.

Since the mass of fluid that will leak from the closed compression pocket across the mainrotor thread to the suction plenum is proportional to the square root of the absolute pressure difference, it becomes advantageous to have the change of volume occur late in the cycle so as to delay onset of this pressure differential for as long as possible. Therefore, referring to FIG. 3, this invention utilizes the pressure curve corresponding to the positive rate-of-volume change in order to lose the least amount of fluid over the crest of the thread during a compression cycle. This objective is accomplished by controlling the rate at which the volume is swept out of the mainrotor. In the present invention, the radial distance from the conical mainrotor spin axis to the center of the gaterotor tooth engagement area increases as the gaterotor sweeps through the mainrotor. Therefore, the volume change increases as indicated by the (+) line in FIG. 1. The geometry of this mainrotor is thus configured so that the volume in the thread is swept out slowly at the beginning of the cycle and more quickly at the end — in contrast to the design practice for the prior art single screw compressors. The increase in discharge pressure capability associated with the reduction in thread leakage outweighs the momentary requirement for higher torque toward the end of the compression cycle.

Figure 4:
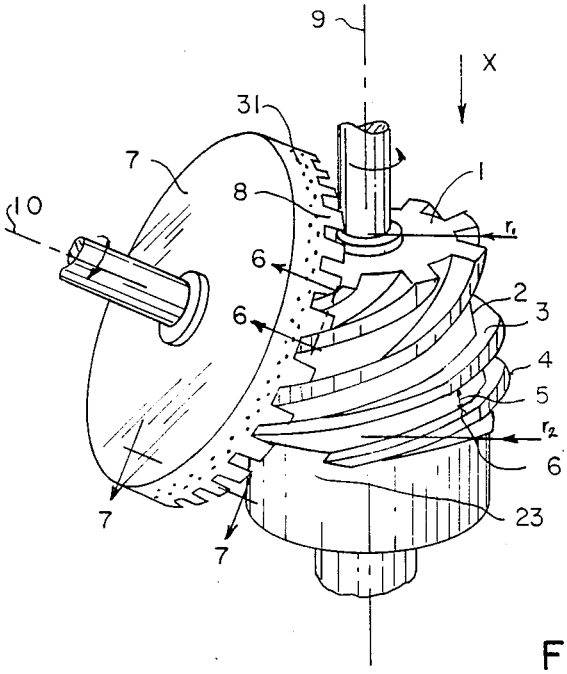
FIG. 4 is a perspective view showing a preferred embodiment of the present invention comprising a compound conical mainrotor, a cylindrical gaterotor with labyrinthial seals, and associated components of the single screw compressor.

In the preferred embodiment of FIG. 4, X indicates the direction of inlet fluid which is to fill the suction plenum. The compound conical mainrotor 1 has a truncated conically tapered base surface 2 with a plurality of projecting spiral threads 3 whose crests 4 are parallel to such conical base surface. The root width 5-thread height 6 of this mainrotor define substantially constant cross sectional chamber areas between adjacent threads along their length for fluid-tight meshing with the teeth of the cylindrical gaterotor 7. The arrows present on the mainrotor shaft axis 9 and gaterotor shaft axis 10 indicate their resPective direction of rotation. When a gaterotor tooth 8 passes through the mainrotor, the velocity of the mainrotor relative to a point on the gaterotor will change. This can be visualized by considering that a predetermined point on the gaterotor tooth will be engaged in the mainrotor at different distances from the mainrotor centerline as the gaterotor point progresses through the conical mainrotor. This variation in the distance from the mainrotor spin axis yields different velocities for a constant mainrotor angular velocity. This change in velocities is best understood by reference to the following equation: $v = r \times \omega$ where v designates linear velocity, $\omega$ designates angular velocity, and r represents the radial distance from the mainrotor spin axis to the center of the thread height as indicated by $r_1$ through $r_2$ in FIG. 4. As the gaterotor progresses through the conical taper of the mainrotor from the smaller radius $r_1$ at the inlet end to a larger radius $r_2$ at the discharge end, it is being driven at a constant speed so that the angular velocity remains unchanged and because the distance of the point on the gaterotor from the mainrotor axis is increasing, it is evident that the linear velocity of the mainrotor will increase. Utilizing this controlled compression cycle thus obtains more compression at the later end of the cycle and reduces the losses out of the closed compression pocket by reducing the time that significant pressure differences across the thread leakage paths exist.

Leakage paths out of the closed compression pocket, which are the major source of pressure loss, can be classified into at least two major types. In addition to the paths across the mainrotor thread as indicated above, there are leakage paths past the gaterotor tooth. As indicated in FIG. 6, the primary source of the latter leakage are the paths past the gaterotor tooth flank edges 11*a* and 11*b* which seal on a plane 12 against the mainrotor leading 13 and trailing 14 thread walls during engagement and are required to separate the pressures in the closed compression chamber 15 from the suction plenum 16. For state of the art single screw machines that operate at low pressure gradients, less than 20 atmospheres, the ratio of mainrotor thread length to gaterotor tooth flank length generally averages 1.8 when the gaterotor tooth initially closes the mainrotor thread. Mainrotor thread length is the length of the edge of the compression groove that separates the compression pocket from the suction plenum. The gaterotor tooth flank length is the combined length of the two flanks of the gaterotor tooth in the mainrotor groove. However, for a single screw machine that is required to operate with a high pressure gradient, greater than 30 atmospheres, the ratio of thread length to flank length should be higher. The reason that this ratio should be raised, is that the higher the ratio, the smaller the flank leakage path length and hence the smaller the pressure losses past the gaterotor teeth flanks.

In the present invention the length of these two major types of leakage paths has been carefully chosen to meet high pressure conditions. The compound conical mainrotor shown in FIG. 4 features substantially constant cross sectional chamber areas between adjacent mainrotor threads which enables reduction in gaterotor teeth flank length over conventional designs. The cylindrical or toroidal mainrotor designs of the prior art have a variation in thread height along their length that requires elongated gaterotor teeth flanks which must penetrate the maximum thread height for fluid-tight engagement. While it is not necessary to have equal dimensions for the mainrotor root width 5 and the thread height 6 in order to obtain substantially constant cross sectional mainrotor chamber areas along their length, the compound conical mainrotor 1 geometry described earlier allowed for cylindrical gaterotor 7 teeth 8 length reduction so as to achieve a thread to flank length ratio in excess of 6.0 in the present invention.

It should be recognized that a high ratio of thread length to flank length by itself would decrease the performance of the single screw machine when operated at high pressure gradients since such corresponds directly to a high thread leakage path length. The idea of high length ratio is only useful when utilized in conjunction with &he controlled compression cycle concept described earlier. The controlled compression cycle reduces the losses across all leakage paths, but it has its greatest benefit on the thread leakage path. Therefore, the high length ratio is used to reduce the losses past the gaterotor tooth flank and the controlled compression cycle is used to reduce the losses across the mainrotor thread.

The relative angle change of the gaterotor tooth flank as it rotates through the mainrotor also has a significant effect on the leakage path past the flank. The angles by which the gaterotor flanks must be relieved, in order to permit fluid-tight engagement with the mainrotor thread walls, is influenced by at least two factors. When the gaterotor tooth passes through the mainrotor, the linear velocity, discussed earlier, of the mainrotor relative to a point on the gaterotor increases from inlet to discharge. Additionally, the angle of orientation between the gaterotor axis relative to the mainrotor spin axis contributes to this flank relief requirement. Thus, conventional gaterotor tooth flank design is represented by the convergence of two skewed planes machine beveled at the minimum and maximum relative angles of engagement with the mainrotor thread so as to create single sealing edges 11*a* and 11*b* of FIG. 6 along the tooth flanks' length in a direction that is parallel to the gaterotor spin axis.

These relative angles are determined by the angle which resultant vectors of the linear velocity vector of the mainrotor make with linear velocity vector of the gaterotor. The angle, by which the gaterotor tooth thickness must be relieved, is at a minimum value when a point on the gaterotor tooth flank is in the region of the mainrotor thread crest as it engages and of a maximum value when the point on the tooth disengages and exits the mainrotor. The minimum 17 and maximum 18 relative angles of the present invention are indicated in FIG. 6 and it should be noted that these angles are measured from a radial line extending to the center of the gaterotor spin axis 10. It should also be recognized that each gaterotor tooth flank must be relieved by these angles and that these flank angles remain parallel about the sealing plane 12 throughout the compression cycle.

If there were no relative angle change, the total thickness of the gaterotor tooth could act as resistance to the flow out of the closed compression chamber. In that case, the flank of the gaterotor tooth would be parallel to the mainrotor thread. It is not possible to achieve this in the conventional machine due to several variables including the mainrotor/gaterotor axis angle of inclination and the wrap angle slope at which the mainrotor thread is wound with respect to the plane of rotation of the gaterotor. However, it is possible to bias the orientation of the gaterotor axis relative to the mainrotor so as to minimize the relative angle change, that is the difference between the relative minimum 17 and maximum 18 angles, by which the gaterotor tooth flank must be relieved. This objective was achieved in the present invention by optimizing the interrelationship between the gear ratio of the gaterotor relative to the mainrotor, the size of the rotors, the angles of engagement between the gaterotor and the mainrotor, and the angle of inclination and the centerline distance between the mainrotor axis and the gaterotor axis. Optimization was performed by varying one of the variables until the minimum flank angle change was achieved. The process was repeated for each of the variables. After all of the variables had been minimized the process was repeated until the minimum flank angle change was achieved. This optimization procedure resulted in selection of an angle of inclination between the mainrotor axis and the gaterotor axis that is set off transverse by an amount that is equal to the angle at which said conical mainrotor surface is tapered. This orientation provides a low relative angle change on the gaterotor tooth flanks.

Figure 9:
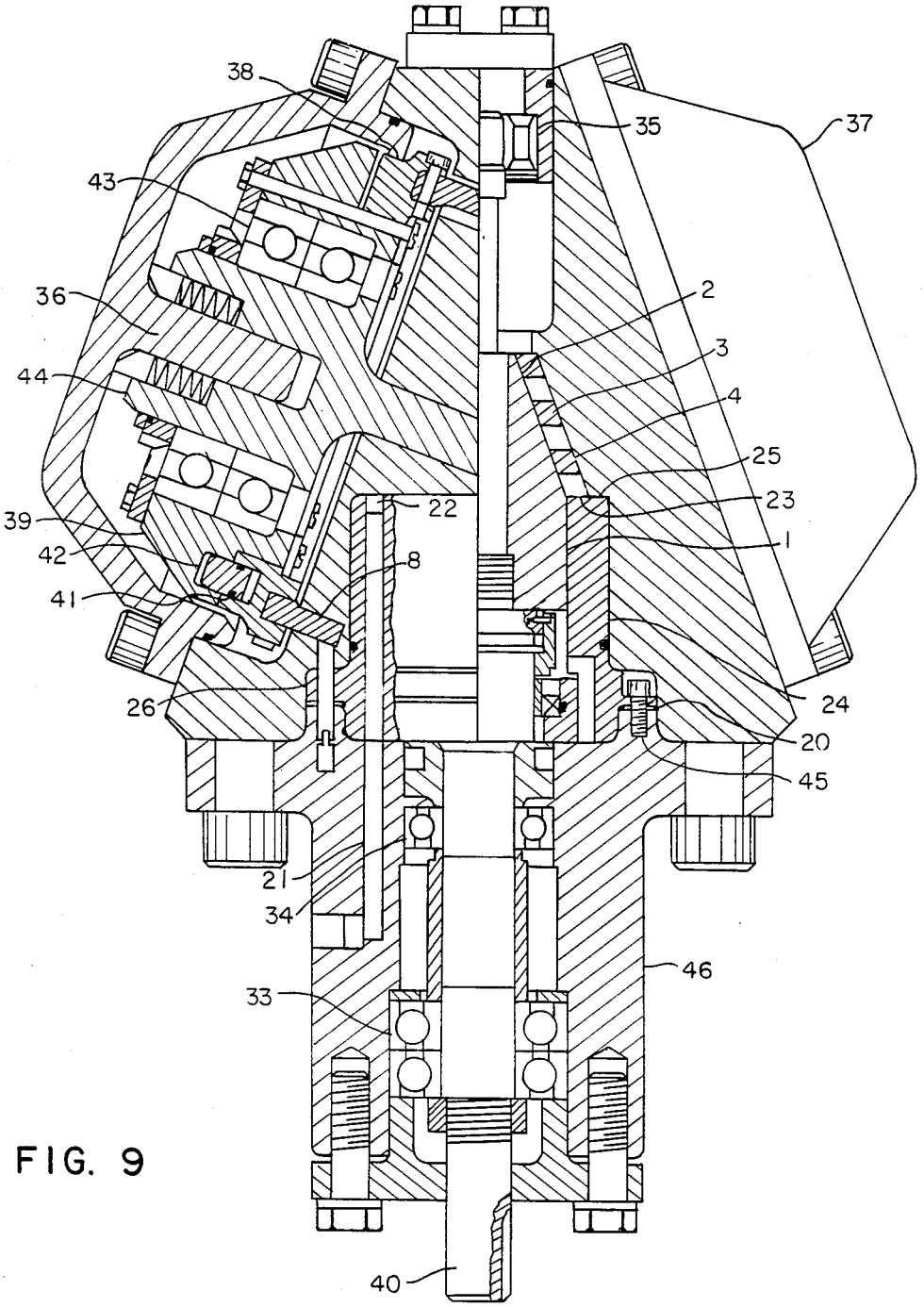
FIG. 9 is a cross sectional view of a compressor assembly constructed in accordance with the teachings of the present invention.

In the embodiment represented in FIG. 9, the maximum diameter of the mainrotor is 2.895 inches with 8 threads and the outside and inside diameters are tapered at a 20° angle. The gaterotor sealing diameter is 5.906 inches with 33 teeth. The inclination angle between the mainrotor axis and the gaterotor is also 20° and the distance between the axes is 5.906 inches. The gaterotor teeth penetrate 0.236 inch into the mainrotor and the tip of each tooth is 0.236 inch wide. The leading gaterotor teeth flanks are cut at a 10° slope off parallel. In this embodiment, the gaterotor teeth flank relief angles at the tip are 47° maximum and 40° minimum and at the root are 41° maximum and 32° minimum —for an average flank relief angle difference of 8 degrees. This is in contrast to the 42° maximum minus 17° minimum or 25 degree average relief angle difference for the prior art single screw machines. This geometry results in the standard convergent/divergent leak passage but for a gaterotor tooth that is 5 millimeter thick, this equates to compression side flank angles, called blowholes and indicated by the cross hatched areas 19a and 19b in FIG. 6, that are less than 1 millimeter. Therefore, the resistance to leakage by the gaterotor tooth flank is substantially increased over the present art machines when the geometry is designed in accordance with the present invention so as to minimize the relative angle change of the gaterotor tooth flank.

Figure 5:
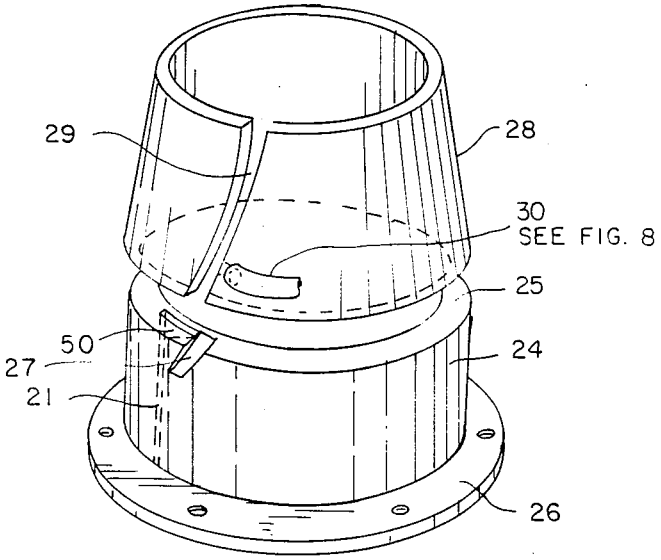
FIG. 5 is a schematic view of the two piece compressor housing comprising a truncated conical upper portion and a discharge ring lower portion wherein is cut a window path opening which is fitted on one side with a hydrostatic injection port in said upper portion and on the other side with an axial discharge port set in said discharge ring.

The upper portion of the compressor housing, schematically represented at 28 in the preferred embodiment of FIG. 5, comprises a truncated cone having a bore symmetry which surrounds the mainrotor, at least to a partial extent, and is configured to cooperate in a fluid-tight manner with the surface of revolution of the mainrotor thread crests during rotation. Present art single screw mechanisms that raise the pressure of a fluid, discharge the fluid through a port which is radially aligned with respect to the axis of rotation of the mainrotor. This arrangement can be effectively sealed at low pressure but the losses become significant at high pressure gradients. The present art seals are also limited by the clearance between the mainrotor and the upper housing bore.

As shown in the preferred embodiment of FIG. 5, the present invention utilizes an axial discharge port 21 which is aligned in parallel with respect to the spin axis of the mainrotor. This port's initial opening 50 is extended into the upper plate 25 of the discharge ring 24 in a direction coincident with the wrap angle of the mainrotor spiral thread winding for a distance beyond the window path opening end joining an arc shaped half funnel at 22 before joining said parallel passage 21 in the discharge ring 24 of the housing. Initial discharge port opening is 50 and groove 27 is an extension of window path 29 which accommodates the gaterotor. By using an axial discharge port, the seal clearance at the underside of the mainrotor thread ends 23, which overlap the discharge ring 24 on the upper surface 25 of the ring, can be adjusted by lifting the upper contact surface 25 of the discharge ring 24 which forms the lower portion of the stationary mainrotor housing. Lifting is accomplished by introducing annular gasket shims 20 under the integral discharge ring flange 26 which are held in by screws 45 secured through to the drive end housing 46 (shown in FIG. 9 only). Recalling that use of the controlled compression cycle discussed earlier takes longer to sweep out a given volume, the discharge port 21 opens later in the cycle which allows the port of the present invention to be of a relatively smaller diameter when compared to the axial discharge port diameters of the prior art. There is loss around the boundaries of any discharge port, which is always at discharge plenum pressure, but the combination of funnel opening at 22 and smaller diameter port 21 reduces the leakage at this path.

The compound conical mainrotor 1, the axial discharge port 21, and associated components of a single screw compressor constructed in accordance with the teachings of the present invention is shown in FIG. 9. Piecemarks 1 through 4, 8, and 21 through 26 are similarly indicated in the embodiment illustrated therein. The mainrotor shaft 40 of the conical mainrotor 1 is supported in the drive end housing 46 by a pair of angular contact bearings 33 to provide axial location; a radial bearing 34 to provide radial location and support; and at the suction end by a cylindrical roller bearing 35. A dual gaterotor assembly and its associated components are shown at 36 and 37. The gaterotors 8 were epoxied into a brass gaterotor support at 38. Support 38 fits onto the gaterotor bearing housing 39 with the angular position located by a resilient O ring 41 mounted on drive pin 42. The assembly is supported by angular contact bearings 43 mounted on the gaterotor shaft 44. A sectional view of the discharge ring is shown at 24. The half funnel opening 22 and axial discharge port 21 are visible in this discharge ring 24 which is in a position below the mainrotor thread extremity 23. The relatively small diameter of the axial discharge port is evident. Plastic gasket shims 20 were used under the discharge ring flange 26 for adjustment of the upper contact surface's 25 seal clearance and were held in place by screws 45 secured through to the drive end housing 46.

By incorporating the aforementioned improvements, the high pressure compressor of FIG. 9 exhibits increased volumetric efficiency when compared with a typical prior art high pressure compressor as can be seen in FIG. 10 Although pressure ratios (that is, absolute discharge to absolute inlet pressure) can be varied within limits in order to obtain a desired discharge pressure, it is evident from the data that the prior art machine, which generally operates at a 2:1 pressure ratio and has 57% volumetric efficiency at a pressure gradient (that is, absolute discharge minus absolute inlet pressure) of 125 psi have been dramatically improved by the present compressor which can operate at a 6:1 pressure ratio and has a 92% volumetric efficiency at a 125 psi pressure gradient. Therefore, the single screw machine of the present invention has shown improved volumetric efficiencies with increased operating pressure ratios and demonstrated higher pressure capabilities with pressure gradients that can exceed 500 psi.

Figure 7:
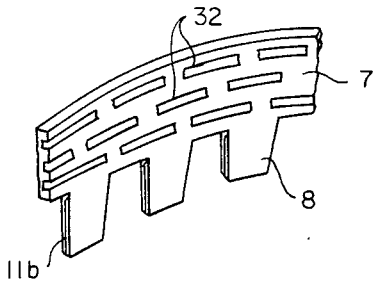
FIG. 7 is an enlarged sectional view of the interior surface of the cylindrical gaterotor wall taken along lines 7–7 of FIG. 4 showing the staggered labyrinthial seals.

Returning to FIG. 5, the opening through which the gaterotor teeth extend through the compressor housing for engagement with the mainrotor is referred to as the window path 29. In the preferred embodiment, labyrinthial seals have been fitted to prevent leakage at the window path 29 from the end of the exiting gaterotor 7. Labyrinthial seals are provided on both the compression and suction sides of the cylindrical gaterotor so as to resist leakage at this window. In the present invention, additional cylinder length is provided to the gaterotor above the teeth root line, so as to allow serrations to be cut into the interior face of the cylinder wall above this line. These staggered circumferential grooves, as can be seen at 32 of FIG. 7, create a labyrinthial seal on the compression side of the gaterotor-window path interface. On the exterior surface, or suction side of the gaterotor, a predetermined plurality of dimpled indentations 31 are formed in a band array circumscribing the outer peripheral wall surface above the teeth root line. Fluid must expand into each groove/indentation where it is intermittently interrupted before it can pass into the next groove/indentation, which slows the leakage through the window path. Leakage flow across the labyrinth seals is thus reduced on both sides of the window opening by the turbulence created at the multiple ridges of the seals.

Figure 8A:
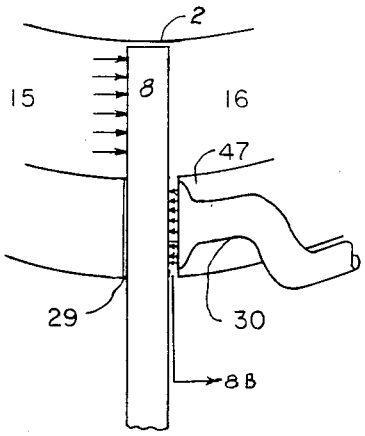
FIGS. 8*a* and 8*b* are section and elevation views respectively of the hydrostatic type pressure port taken from FIG. 5.
Figure 8B:
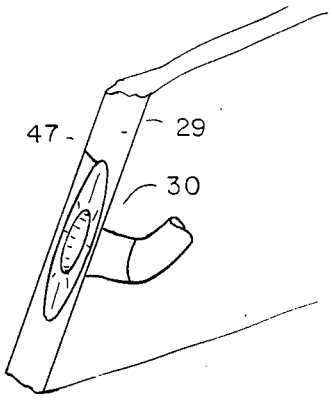

The window path opening 29, through which the gaterotor teeth 8 extend, separates the closed compression pocket pressure from suction pressure, so it is an area that has a large effect on the performance of a high pressure machine. Recalling from FIG. 6 that the pressure in the closed compression pocket 15 is on one side of the gaterotor tooth and suction pressure 16 on the other side, it is apparent that there is a net force on the tooth. This compression force is in a direction that is normal to the tooth face and will tend to deflect an unsupported gaterotor tooth end toward the suction side resulting in the opening up and leaking of fluid through the window path seal on the compression side of the tooth. From the preferred embodiment of FIG. 5, FIGS. 8*a* and 8*b* show this force 15 reacted upon by providing a hydrostatic type pressure port 30 on the non-sealing suction side 16 of the window path 29 opening in the housing. The size and geometry of this typically ellipsoidal orifice 47, shown in FIG. 8*b* elevation, is proportioned to counteract the bending moment force exerted on the tooth by the compression process. When the port 30 is fed by fluid, which may be derived from the discharge outlet holding tank (not shown), whose pressure is substantially opposite to the compression force on the other side of the gaterotor tooth 8, it will act to counter balance force 15 and keep the window path 29 seal clearance at a close tolerance on the compression side of the tooth.

Past practice in using the single screw mechanism as a compressor or pump has provided a single gaterotor tooth to seal off individual mainrotor threads, thereby separating the higher pressure fluid from the inlet suction pressure fluid. This single tooth must fit very closely in the mainrotor threads to minimize internal leakage and withstand the differential pressure forces applied to the tooth. Formerly, these factors have made it necessary to use nonmetallic gaterotor teeth backed by metallic supports on the low pressure side to provide adequate tooth stiffness. The inclusion of the hydrostatic type pressure port 30 makes it possible to use a gaterotor tooth which has less or no need for additional structural support by way of metallic backup stiffeners, as is shown in FIG. 6, and therefore allows use of gaterotor teeth which are self supporting in design.

In addition to permitting a reduction in gaterotor tooth thickness and reducing losses through the window leakage path, another benefit!t of the hydrostatic type pressure port 30 is that it increases resistance to the leakage path along the tooth flanks in the direction parallel to the gaterotor spin axis. In all present art single screw mechanisms, there exists sealing gaps at the mainrotor thread crest-gaterotor tooth root-housing interface. During rotation, compressed fluid emanating at the leading gaterotor relief angles flow up 19*a* and 19*b* in FIG. 6 and over the mainrotor thread sealing the closed compression chamber from the trailing suction chamber through these blowhole gaps which are present at the root between adjacent gaterotor teeth and the crest of the mainrotor engaging thread. In accordance with the teaching of the present invention, the single screw machine's preferred geometry is arranged so that the size of these root gap blowhole areas remain constant. Fluid continues to leak up and out of the closed compression chamber over the thread crest to the trailing chamber which is at a lower pressure however, in order for the fluid to get out of the enclosed pocket, the compressed fluid will have to pass through a blowhole where it is opposed by fluid at equal pressure introduced at the exiting gaterotor teeth root by orifice 47. Thus, in order to get to the suction plenum, compressed fluid will have to pass through an effective seal interposed on the suction side of the window path by the hydrostatic type pressure port 30, creating a more arduous passage and a longer leakage route in order for the compressed fluid to escape thereby reducing blowhole pressure losses.

In a gas compressor, liquid may be injected in the vicinity of the inlet port for lubrication and for sealing purposes. Liquid remaining on the compression side of the mainrotor chamber typically is evacuated with the compressed gas during discharge. In the present invention, liquid may also be introduced by the hydrostatic type pressure port 30 into the suction side of the mainrotor chamber. If left to accumulate in any significant amount, liquid leaking out of the compression pocket past the gaterotor teeth flanks and from the hydrostatic pressure port into the suction plenum will reduce the efficiency of a single screw machine. This liquid can be excavated centrifugally as disclosed, by way of example, in the inventor's U.S. Pat. No. 4,775,304, which is hereby incorporated by reference. In a dual gaterotor embodiment, any accumulated liquid can be mechanically scavenged by an auxiliary gaterotor as disclosed, by way of example, in the inventor's U.S. patent application Ser. No 06/885,478, filed Jul. 3, 1986 which is also hereby incorporated by reference.

It should be understood that the characteristic slope obtained for the positive rate of volume change will vary for different compound conical mainrotor/cylindrical gaterotor size combinations; that the mainrotor/-gaterotor inclination angle where the relative gaterotor flank angle change is minimized must be found for each different size combination; that the size, location and geometry of the hydrostatic type pressure port is chosen to meet particular design requirements; and that the size, kind, and placement of labyrinthial seals is also subject to the design into which it is to be incorporated In addition to the high pressure design application described herein, this invention is clearly an attractive configuration for applications where, even though the overall pressure gradient is below 20 atmospheres, the losses across the flanks and threads are excessive. This would occur in non-liquid flooded machines or in machines where the sealing fluid has a low viscosity.

Therefore, while this disclosure has focused on the field of compressor technology, and in a similar reverse manner to expanders, the improvements relating specifically to minimizing flank relief angles and introducing a hydrostatic pressure port may be incorporated into pumps and hydraulic motors which are required to operate on compressible fluids. Obviously numerous modifications and variations of the present invention are possible in light of the above teachings. It is therefore to be understood, that within the scope of the appended claims, the invention may be practiced otherwise than as specifically described herein.

What is claimed is:

1. A single screw mechanism of the positive displacement rotary type for varying the pressure of a fluid between a high pressure port and a low pressure port, comprising:

a compound conical mainrotor formed with a truncated conical base surface and a plurality of threads projecting from said base surface, said threads of relatively constant height with respect to said base surface over the length of said mainrotor;

a casing having a window, said casing cooperating with said mainrotor threads forming at least one chamber, each said chamber of substantially constant cross sectional areas over the length of said threads, each said cross sectional area taken transverse to the length of said threads, said conical mainrotor disposed in said casing such that the large diameter of said conical mainrotor is adjacent said high pressure port and the small diameter of said mainrotor is adjacent said low pressure port;

a least one cylindrical gaterotor having a plurality of projecting teeth, said gaterotor having a flank relief angle by being rotatably mounted on an axis transverse with respect to said conical base surface of said mainrotor, one tooth of said gaterotor cooperating with each said fluid chamber through said window during each operating cycle causing the pressure of a fluid within said chamber to vary as said gaterotor tooth progresses between said high and low pressure ports; said gaterotor rotatable with respect to said mainrotor in a direction such that the volume swept by a gaterotor tooth per degree of mainrotor rotation is greater when said gaterotor tooth is near said high pressure port than said volume swept per degree of mainrotor rotation when said gaterotor tooth is near said low pressure port.

2. A single screw mechanism as claimed in claim 1, further comprising a hydrostatic pressure port in one side of said window opening, said hydrostatic port in fluid communication with said high pressure port and operative on said gaterotor such as to counteract forces tending to deflect said gaterotor toward one side of said window.

3. A single screw compressor as claimed in claim 2 wherein said gaterotor further comprises a revolved surface from which said gaterotor teeth project, said revolved surface operative within said window, said revolved surface having indentations which during rotation within said window from labyrinthial seals within said window.

4. A single screw mechanism as claimed in claim 2 wherein said hydrostatic pressure port is elipsoid shaped.

5. A single screw compressor as claimed in claim 1 wherein the average flank relief angle of said gaterotor teeth is about 8 degrees.

6. A single screw mechanism as claimed in claim 1 wherein the angle of inclination of the gaterotor axis with respect to the mainrotor axis is equal to the angle of taper of said conical mainrotor.

7. A single screw mechanism as claimed in claim 6 wherein said angle of inclination and said angle of taper are each 20 degrees.

8. A single screw mechanism as claimed in claim 1 wherein the ration of mainrotor thread length to gaterotor tooth flank length is greater than 6.0.

9. A single screw mechanism of the positive displacement rotary type for varying the pressure of a fluid between a high pressure port and a low pressure port, comprising:

a mainrotor formed with a plurality of threads, a casing cooperating with said mainrotor threads forming at least one chamber, said casing having a window opening;

a gaterotor having a plurality of teeth cooperating with each said chamber through said window opening in said casing, said gaterotor teeth dividing said chamber into high and low pressure volumes such that a differential pressure across a gaterotor tooth within said chamber tends to deflect said gaterotor toward one side of said window opening;

a hydrostatic pressure port disposed in said one side of said window opening, said hydrostatic port in fluid communication with said high pressure port and operative on said gaterotor so as to counteract forces tending to deflect said gaterotor toward said one side of said window.

10. A single screw mechanism as claimed in claim 9 wherein each said gaterotor is a cylindrical gaterotor.

11. A single screw mechanism as claimed in claim 9 wherein said mainrotor is a compound conical mainrotor and each said gaterotor is a cylindrical gaterotor.

12. A single screw mechanism as claimed in 11 wherein said compound conical mainrotor is formed with a truncated conical base surface and a plurality of threads projecting from said surface, said threads of relatively constant height over the length of said mainrotor.

13. A single screw compressor as claimed in claim 11 wherein at least one surface of said gaterotor which surface is operative within said window path has indentations such that during rotation with respect to said window path a labyrinthial seal is formed within said window.

14. A single screw mechanism as claimed in 11 wherein the average flank relief angle of the teeth of said gaterotor with respect to the teeth of said mainrotor is about 8 degrees.

15. A single screw mechanism as claimed in claim 11 wherein the angle of inclination of the gaterotor axis with respect to the mainrotor axis is equal to the angle of taper of said conical mainrotor.

16. A single screw mechanism as claimed in claim 11 wherein said angle of inclination and said angle of taper are 20 degrees.

17. A single screw mechanism as claimed in claim 11 wherein the ratio of mainrotor thread length to gaterotor tooth flank length is greater than 6.0.

18. A single screw mechanism as claimed in claim 11 wherein said machine is a compressor operable at a pressure ratio of 6 to 1 with a 92 percent volumetric efficiency at a pressure gradient of 125 psi.

19. A single screw machine in accordance with claims 11 wherein said gaterotor teeth are self supporting.

20. A single screw mechanism of the positive displacement rotary type for varying the pressure of a fluid between a high pressure port and a low pressure port, comprising:

a casing having a conically shaped bore and an arc shaped window;

a first plate attached to said casing, said plate at least partially closing the smaller end of said bore;

a compound conical mainrotor formed with a truncated conical base surface and a plurality of threads projecting from said surface, said threads of relatively constant height over the length of said mainrotor, said mainrotor threads cooperating with said conically shaped bore forming at least one fluid chamber having substantially constant cross sections when each said cross section is taken transverse to the length of said thread;

a second plate closing the larger end of said bore, said plate having a spiral shaped port therein, said spiral shaped port having the same pitch as said threads of said mainrotor, said spiral shaped port in fluid communication with said high pressure port;

a cylindrical gaterotor having a plurality of projecting teeth, said gaterotor having a flank relief angle by being rotatably mounted on an axis transverse with respect to said conical base surface of said mainrotor, one tooth of said gaterotor cooperating with each said fluid chamber through said arc shaped window during each operating cycle causing the pressure of a fluid within said chamber to vary as said gaterotor tooth progresses between said high and low pressure ports, said gaterotor teeth passing through said spiral shaped port in said second plate when said gaterotor and said mainrotor are rotated.

21. A single screw mechanism as claimed in claim 20 further comprising an arc shaped funnel disposed between said spiral shaped port and said high pressure port.

22. A single screw compressor as claimed in claim 20 wherein at least one surface of said gaterotor which surface is operative within said window path has indentations such that during rotation with respect to said window path a labyrinthial seal is formed within said window.

23. A single screw mechanism as claimed in claim 20 wherein the average flank relief angle of the teeth of said gaterotor with respect to the teeth of said mainrotor is about 8 degrees.

24. A single screw mechanism as claimed in claim 20 wherein the angle of inclination of the gaterotor axis with respect to the mainrotor axis is equal to the angle of taper of said conical mainrotor.

25. A single screw mechanism as claimed in claim 24 wherein the said angle of inclination and said angle of taper are 2 degrees.

26. A single screw mechanism as claimed in claim 20 wherein the ratio of mainrotor thread length to gaterotor tooth flank length is greater than 6.0.

27. A single screw mechanism as claimed in claim 20 wherein said machine is a compressor operable at a pressure ratio of 6 to 1 with a 92 percent volumetric efficiency at a pressure gradient of 125 psi.

28. A single screw mechanism as claimed in claim 20 further comprising: a hydrostatic pressure port disposed in said one side of said arc shaped window opening, said hydrostatic port in fluid communication with said high pressure port and operative on said gaterotor so as to counteract forces tending to deflect said gaterotor toward said one side of said window.

29. A single screw mechanism as claimed in claim 28 wherein said gaterotor teeth are self supporting.

* * * * *